US009004379B2

(12) United States Patent
Wang

(10) Patent No.: US 9,004,379 B2
(45) Date of Patent: Apr. 14, 2015

(54) PAINT CONTAINER ASSEMBLY FOR A PAINT SPRAYER

(71) Applicant: Hsing-Tzu Wang, Taichung (TW)

(72) Inventor: Hsing-Tzu Wang, Taichung (TW)

( * ) Notice: Subject to any disclaimer, the term of this patent is extended or adjusted under 35 U.S.C. 154(b) by 3 days.

(21) Appl. No.: 13/964,199

(22) Filed: Aug. 12, 2013

(65) Prior Publication Data

US 2014/0332532 A1 Nov. 13, 2014

(30) Foreign Application Priority Data

May 9, 2013 (TW) ..... 102208615 U

(51) Int. Cl.
*B05B 7/24* (2006.01)
*B65D 51/16* (2006.01)

(52) U.S. Cl.
CPC ..... *B05B 7/2402* (2013.01); *B65D 51/1611* (2013.01); *B05B 7/2408* (2013.01)

(58) Field of Classification Search
CPC .... B05B 11/06; B05B 7/2408; B05B 7/2405; B05B 5/1691; B05B 7/1413; B05B 11/0024; B65D 39/08; B65D 51/1611; B65D 51/1605; B65D 51/16; B65D 51/1683; B65D 51/1672; B65D 47/00; B65D 2547/00
USPC ..... 220/254.7, 254.8, 254.1, 367.1, 601, 220/203.07, 203.04, 203.01; 222/568, 567, 222/566; 239/302, 346, 345; 215/311, 310, 215/307, 378, 370, 902, 356, 355
See application file for complete search history.

(56) References Cited

U.S. PATENT DOCUMENTS

| | | | | | |
|---|---|---|---|---|---|
| 5,582,350 | A * | 12/1996 | Kosmyna et al. | ..... | 239/345 |
| 5,660,306 | A * | 8/1997 | Kim | ..... | 222/83 |
| 6,435,426 | B1 * | 8/2002 | Copp, Jr. | ..... | 239/346 |
| 2006/0113409 | A1 * | 6/2006 | Camilleri et al. | ..... | 239/600 |
| 2007/0205305 | A1 * | 9/2007 | Vagedes | ..... | 239/302 |
| 2013/0206868 | A1 * | 8/2013 | Laffey | ..... | 239/407 |

FOREIGN PATENT DOCUMENTS

| | | | | | |
|---|---|---|---|---|---|
| CA | 2508760 | A1 * | 3/2005 | ..... | B05B 7/24 |
| GB | 1482149 | A * | 8/1977 | ..... | B05B 7/12 |

* cited by examiner

*Primary Examiner* — Robert J Hicks
(74) *Attorney, Agent, or Firm* — Abelman, Frayne & Schwab

(57) ABSTRACT

A paint container assembly includes: a container body; a cover detachably mounted to the container body and having a peripheral end and a central recessed portion which defines a cylindrical recess; and a vent conduit having a cylindrical plug portion and an extension portion. The plug portion is rotatably inserted into the recess. The extension portion has a free open end, and defines a fluid channel extending from an upper end of the plug portion to the free open end. The free open end of the extension portion is disposed adjacent to the peripheral end of the cover and distal from the central recessed portion of the cover for preventing paint material from flowing out of the container body through the fluid channel.

3 Claims, 8 Drawing Sheets

PAINT CONTAINER ASSEMBLY FOR A PAINT SPRAYER

CROSS-REFERENCE TO RELATED APPLICATION

This application claims priority of Taiwanese Application No. 102208615, filed on May 9, 2013.

BACKGROUND OF THE INVENTION

1. Field of the Invention

The invention relates to a paint container assembly for a paint sprayer, and more particularly to a paint container assembly with a vent conduit capable of preventing a paint material from flowing out of the paint container assembly during operation of the paint sprayer.

2. Description of the Related Art

FIGS. 1 and 2 illustrate a conventional paint container assembly 10 for a paint sprayer 1. The paint container assembly 10 includes a container body 11 that defines an accommodating space 101 for receiving a paint material 100 therein, a cover 12 that covers atop opening 111 of the container body 11 and that is formed with a central recess 121, and a vent plug 13 that is inserted into the central recess 121 and that has a surrounding wall formed with a vent hole 131 which is in fluid communication with the accommodating space 101 through the central recess 121. In operation, when a trigger of the paint sprayer 1 is pressed, the paint material 100 in the accommodating space 101 can be drawn into a gun barrel of the paint sprayer 1, which results in generation of a vacuum in the accommodating space 101 and introduction of ambient air into the accommodating space 101 through the vent hole 131 to break the vacuum, thereby permitting a stable spraying rate of the paint material 100 and smooth operation of the paint sprayer 1.

The conventional paint container assembly 10 is disadvantageous in that a problem of leakage through the vent hole 131 (see FIG. 2) may arise when the paint sprayer 1 is tilted at an angle for spraying the paint material 100 to a desired surface (not shown).

SUMMARY OF THE INVENTION

Therefore, the object of the present invention is to provide a paint container assembly that can overcome the aforesaid drawback associated with the prior art.

According to the present invention, there is provided a paint container assembly for a paint sprayer. The paint container assembly comprises: a container body that defines an accommodating space therein and that has a top open end and a bottom outlet port, the accommodating space being adapted to receive a paint material therein, the top open end defining a top opening in fluid communication with the accommodating space and the bottom outlet port, the bottom outlet port being adapted to be connected to the paint sprayer; a cover that is detachably mounted to the top open end, that covers the top opening, and that has a peripheral end and a central recessed portion which is surrounded by the peripheral end, which defines a cylindrical recess, and which is formed with a bottom inlet port in fluid communication with the cylindrical recess and the accommodating space, the central recessed portion extending into the accommodating space; and a vent conduit having a cylindrical plug portion and an extension portion. The plug portion is rotatably inserted into the cylindrical recess, defines an inner space that is in fluid communication with the cylindrical recess, and has an upper end. The extension portion has a free open end, defines a fluid channel that is in fluid communication with the inner space, and extends outwardly from the upper end of the plug portion to the free open end. The free open end of the extension portion of the vent conduit is disposed adjacent to the peripheral end of the cover and distal from the central recessed portion of the cover so as to prevent the paint material in the accommodating space from flowing out of the accommodating space through the cylindrical recess, the inner space and the fluid channel when the paint container assembly is tilted.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
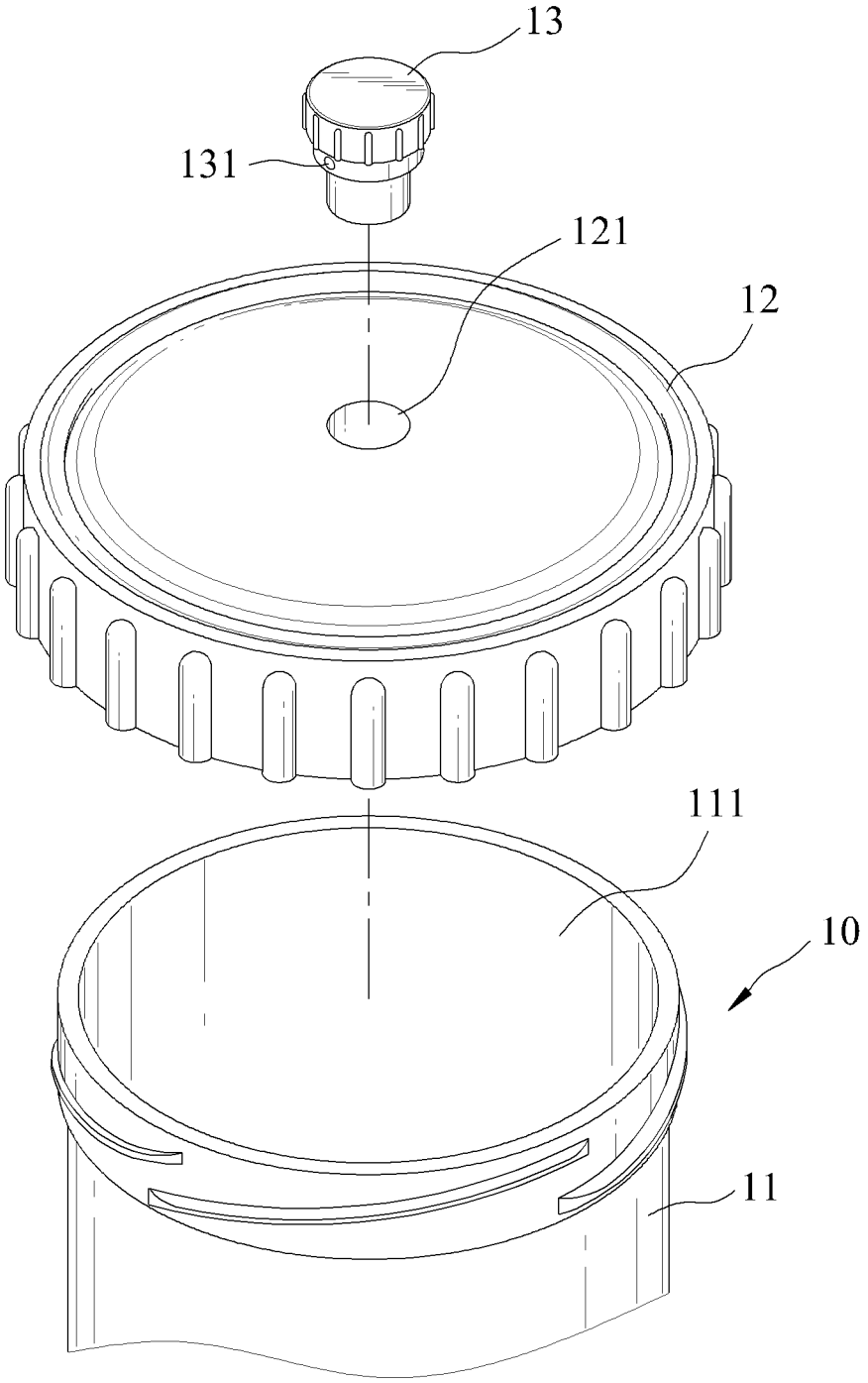
FIG.1 PRIOR ART
FIG. 1 is a fragmentary exploded perspective view of a conventional paint container assembly.
Figure 2:
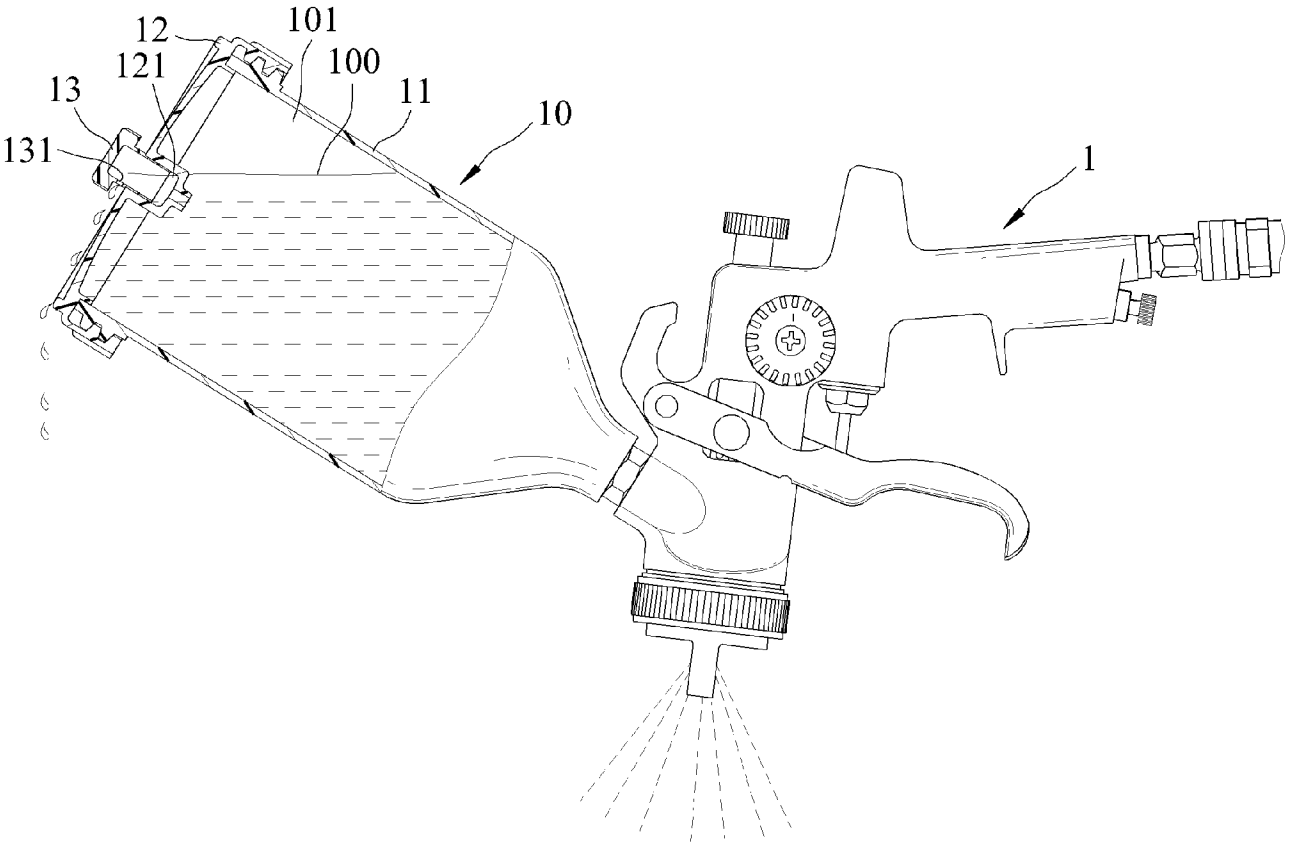
FIG.2 PRIOR ART
FIG. 2 is a partly sectional view of the conventional paint container assembly.
Figure 3:
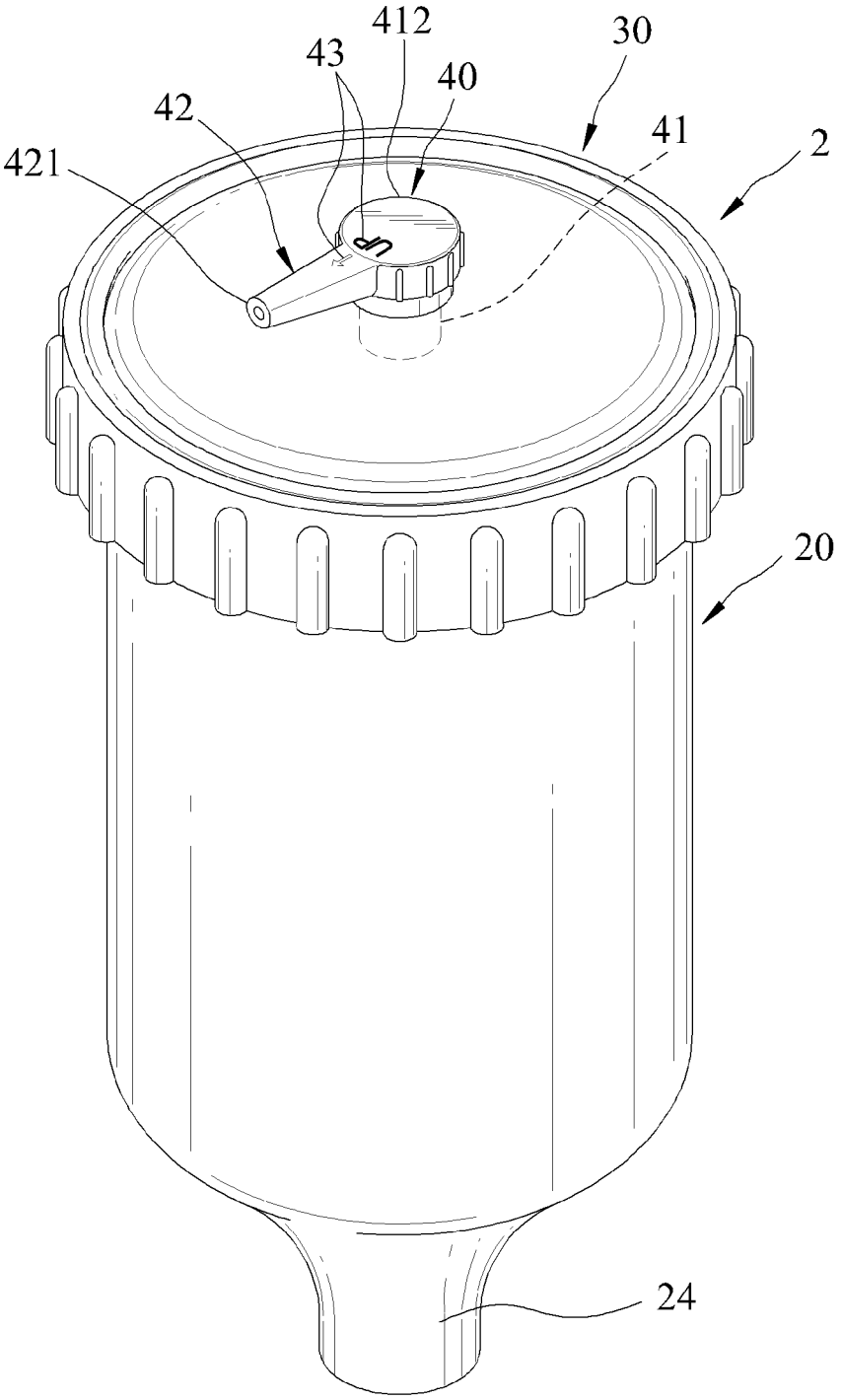
FIG. 3 is a perspective view of the preferred embodiment of a paint container assembly according to the present invention.
Figure 4:
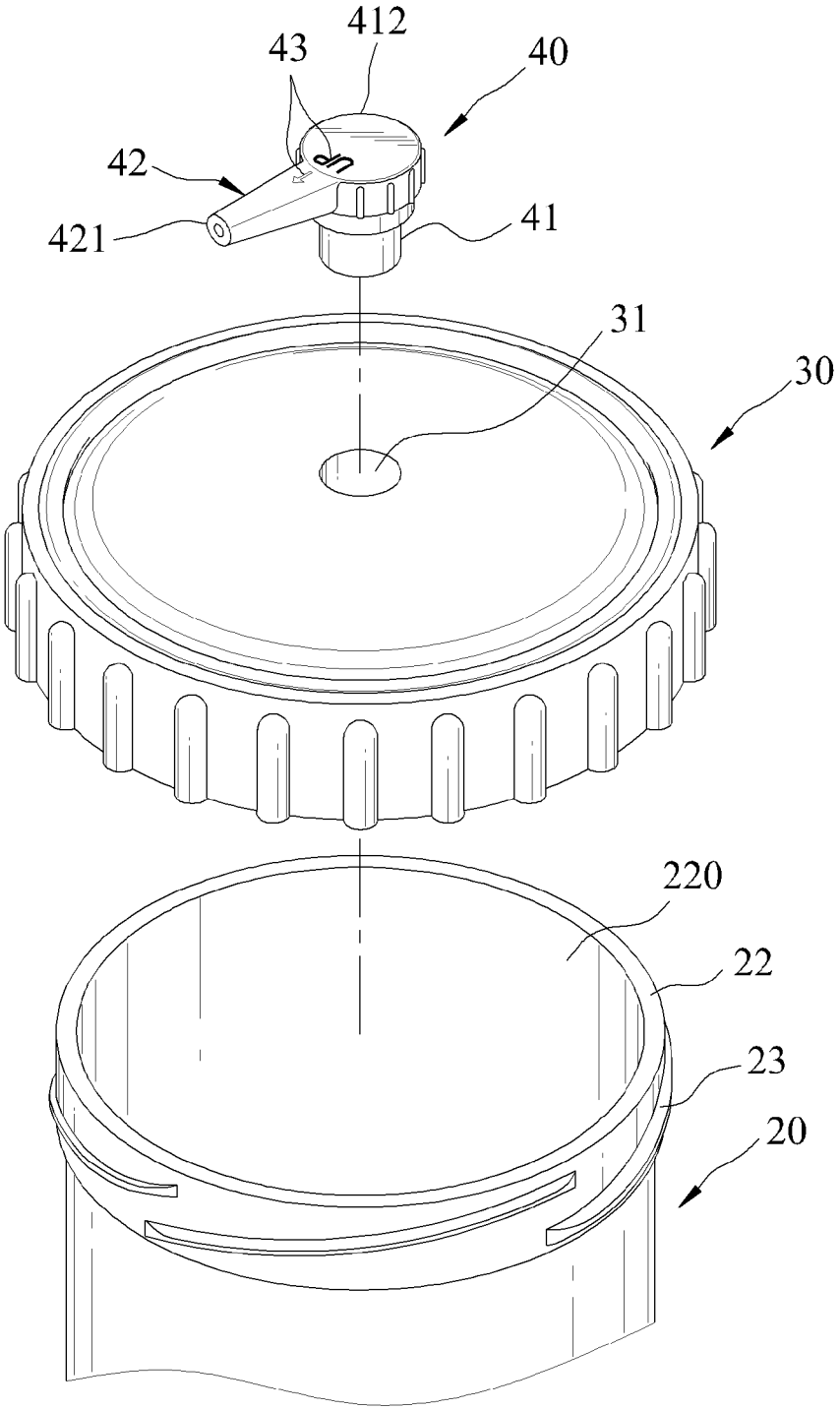
FIG. 4 is a fragmentary exploded perspective view of the preferred embodiment.
Figure 5:
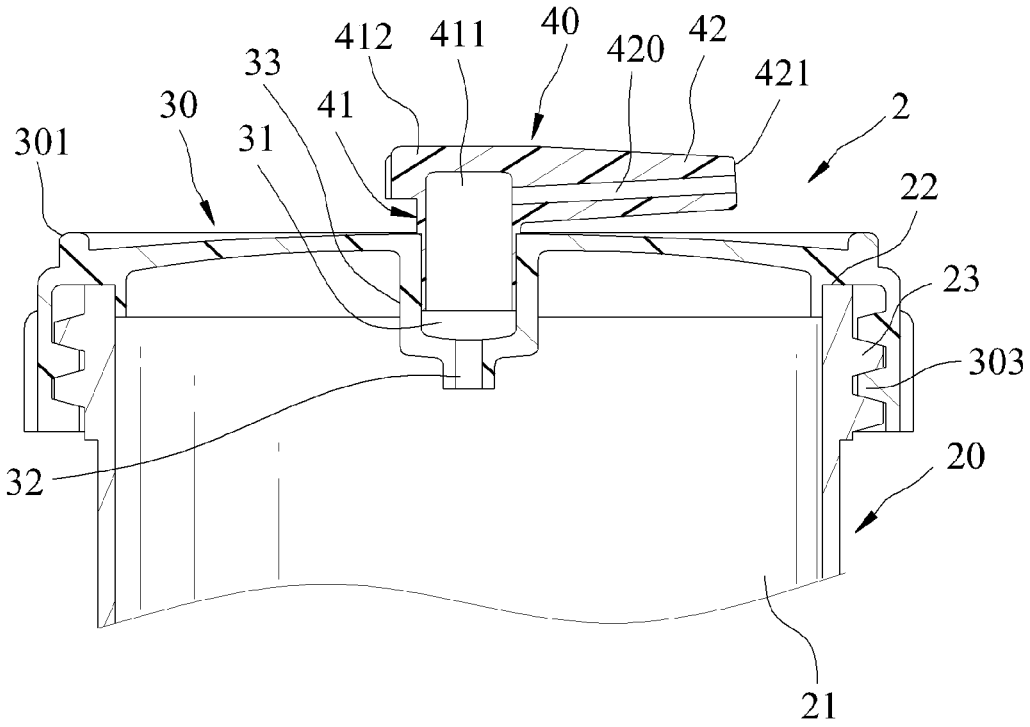
FIG. 5 is a fragmentary sectional view of the preferred embodiment.

FIGS. 3 to 5 illustrate the preferred embodiment of a paint container assembly 2 for a paint sprayer (see FIG. 7) according to the present invention. The paint container assembly 2 includes a container body 20, a cover 30 and a vent conduit 40.

The container body 20 defines an accommodating space 21 therein, has a top open end 22 and a bottom outlet port 24, and is formed with an outer thread 23 adjacent to the top open end 22. The accommodating space 21 is adapted to receive a paint material 100 (see FIG. 7) therein. The top open end 22 defines a top opening 220 in fluid communication with the accommodating space 21 and the bottom outlet port 24. The bottom outlet port 24 is securely connected to the paint sprayer 1.

The cover 30 is detachably mounted to the top open end 22 of the container body 20, covers the top opening 220, and has a peripheral end 301 and a central recessed portion 33 which is surrounded by the peripheral end 301, which defines a cylindrical recess 31, and which is formed with a bottom inlet port 32 in fluid communication with the cylindrical recess 31 and the accommodating space 21. The central recessed portion 33 extends into the accommodating space 21. The cover 30 is formed with an inner thread 303 that engages threadedly the outer thread 23.

Figure 6:
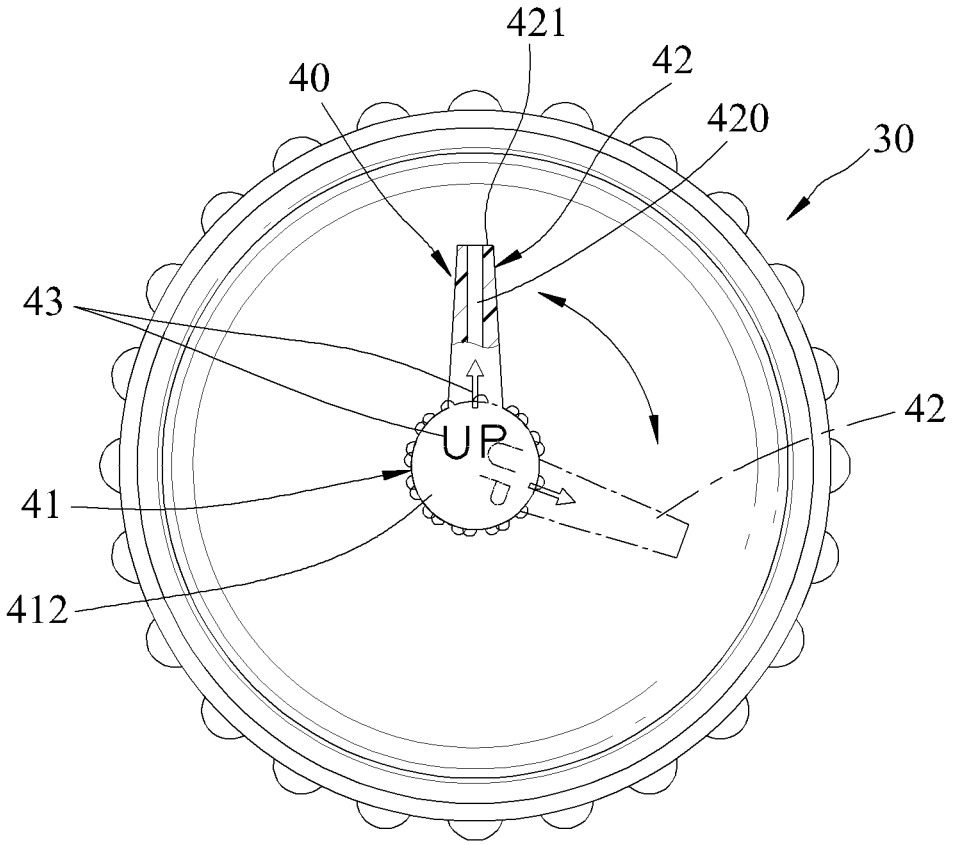
FIG. 6 is a partly sectional top view of the preferred embodiment.

The vent conduit 40 has a cylindrical plug portion 41 and an extension portion 42 extending from the plug portion 41. The plug portion 41 is rotatably and sealingly inserted into the cylindrical recess 31 so as to be rotatable together with the extension portion 42 relative to the cover 30 (see FIG. 6), defines an inner space 411 that is in fluid communication with the cylindrical recess 31, and has an upper end 412. The extension portion 42 has a free open end 421, defines a fluid channel 420 that is in fluid communication with the inner space 411, and extends outwardly from the upper end 412 of the plug portion 41 to the free open end 421 in a radial direction relative to the plug portion 41. The free open end 421 of the extension portion 42 of the vent conduit 40 is disposed adjacent to the peripheral end 301 of the cover 30 and distal from the central recessed portion 33 of the cover 3 so as to prevent the paint material 100 in the accommodating space 21 from flowing out of the accommodating space 21 through the cylindrical recess 31, the inner space 411 and the fluid channel 420 when the paint container assembly 2 is tilted.

A direction-indicating sign 43 is disposed on a top surface of the extension portion 42 and a top surface of the plug portion 41 of the vent conduit 40 for providing a notification to set the free open end 421 of the extension portion 42 to a position above the upper end 412 of the plug portion 41.

Figure 7:
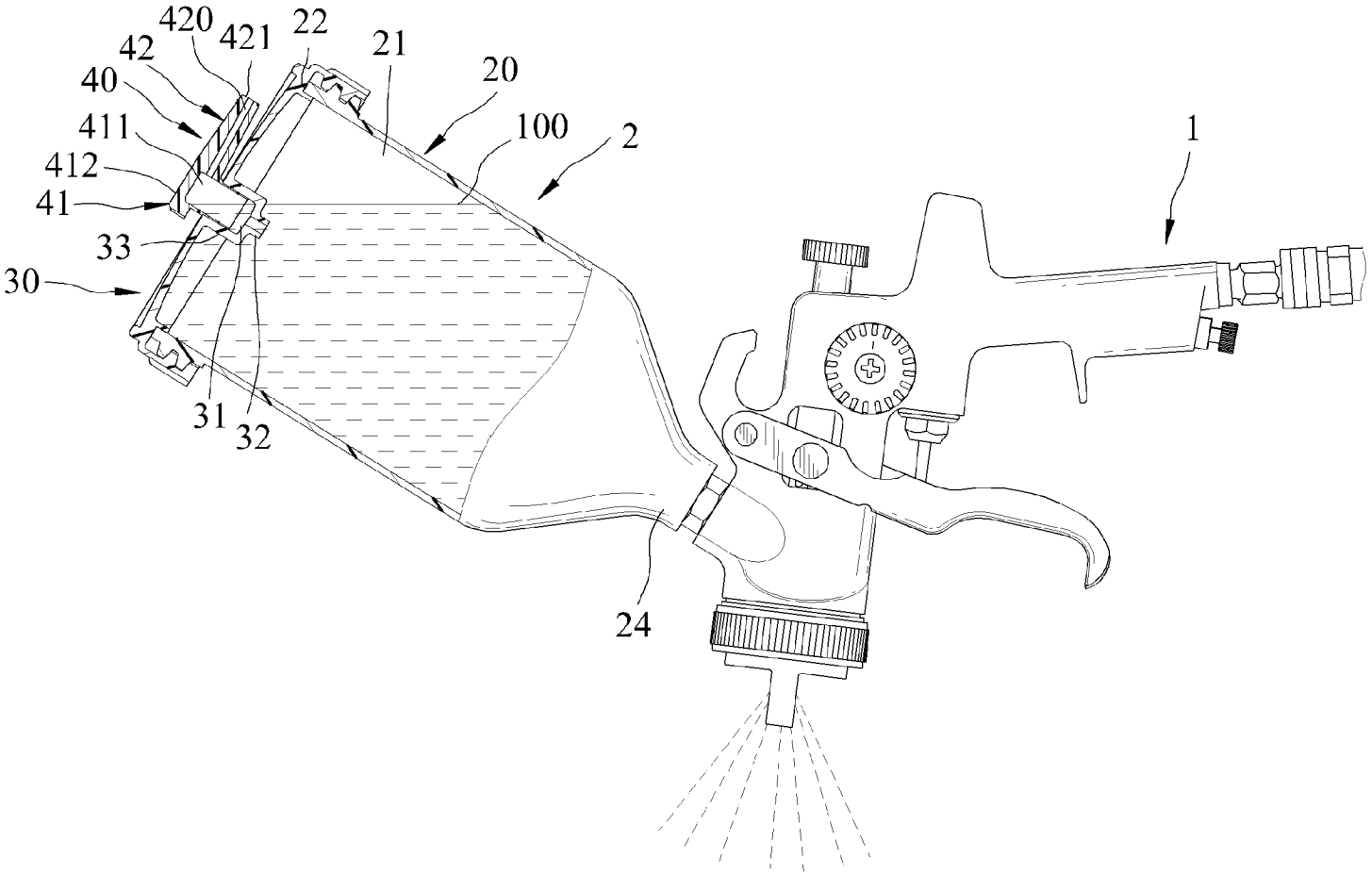
FIG. 7 is a partly sectional view to illustrate a state where the preferred embodiment together with a paint sprayer is tilted at an angle during a spraying operation.

Referring to FIG. 7, when the paint container assembly 2 is tilted at an angle by the user for spraying the paint material 100 downwardly toward an underlying surface (not shown), the extension portion 42 and the plug portion 41 of the vent conduit 40 are rotated to an angular position to dispose the free open end 421 of the extension portion 42 at a position above the upper end 412 of the plug portion 41 in order to prevent the paint material 100 from flowing out of the accommodating space 21 through the fluid channel 420.

Figure 8:
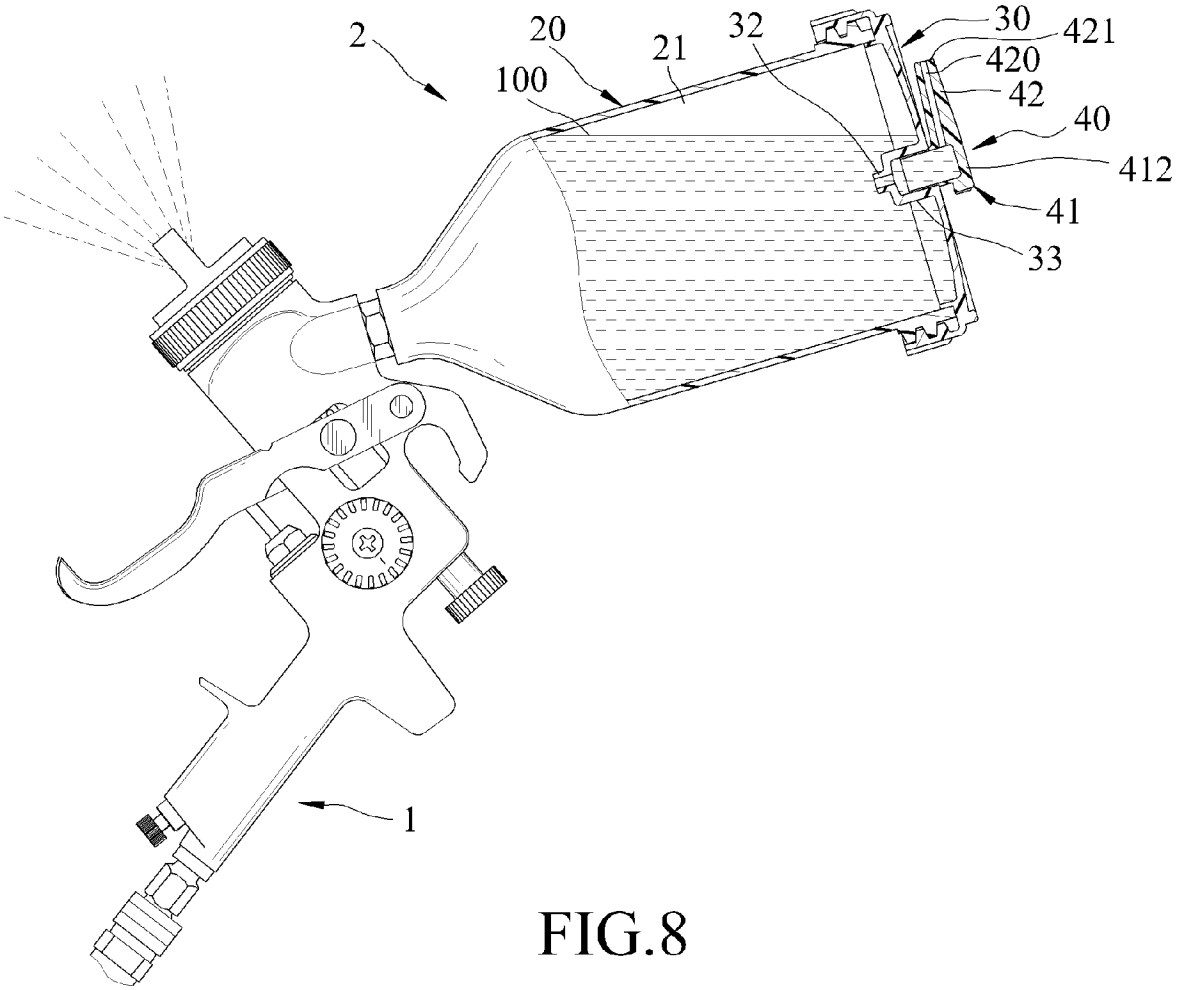
FIG. 8 is a partly sectional view to illustrate another state where the preferred embodiment together with the paint sprayer is tilted at another angle during the spraying operation.

Referring to FIG. 8, when the paint container assembly 2 is tilted at another angle by the user for spraying the paint material 100 upwardly toward an upper surface (not shown), the extension portion 42 and the plug portion 41 of the vent conduit 40 are rotated to another angular position to dispose the free open end 421 of the extension portion 42 at a position above the upper end 412 of the plug portion 41 in order to prevent the paint material 100 from flowing out of the accommodating space 21 through the fluid channel 420.

With the inclusion of the extension portion 42 in the vent conduit 40 of the paint container assembly 2 of the present invention, it is possible to overcome the aforesaid drawback associated with the prior art.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A paint container assembly for a paint sprayer, said paint container assembly comprising:

a container body that defines an accommodating space therein and that has a top open end and a bottom outlet port, said accommodating space being adapted to receive a paint material therein, said top open end defining a top opening in fluid communication with said accommodating space and said bottom outlet port, said bottom outlet port being adapted to be connected to the paint sprayer;

a cover that is detachably mounted to said top open end, that covers said top opening, and that has a peripheral end and a central recessed portion which is surrounded by said peripheral end, which defines a cylindrical recess, and which is formed with a bottom inlet port in fluid communication with said cylindrical recess and said accommodating space, said central recessed portion extending into said accommodating space; and a vent conduit having a cylindrical plug portion and an extension portion, said plug portion being rotatably inserted into said cylindrical recess, defining an inner space that is in fluid communication with said cylindrical recess, and having an upper end, said extension portion having a free open end, defining a fluid channel that is in fluid communication with said inner space, and extending outwardly from said upper end of said plug portion to said free open end;

wherein said free open end of said extension portion of said vent conduit is disposed adjacent to said peripheral end of said cover and distal from said central recessed portion of said cover.

2. The paint container assembly of claim 1, wherein said extension portion of said vent conduit extends in a radial direction relative to said plug portion.

3. The paint container assembly of claim 1, further comprising a direction-indicating sign that is disposed on at least one of said extension portion and said plug portion of said vent conduit for providing a notification to set said free open end of said extension portion to a position above said upper end of said plug portion.

* * * * *